US012025008B2

(12) United States Patent
Hua et al.

(10) Patent No.: US 12,025,008 B2
(45) Date of Patent: Jul. 2, 2024

(54) VERTICAL ORTHOGONAL TOP EXHAUSTING AIR DUCT STRUCTURE OF DEEPLY-BURIED SUBWAY STATION AND CONSTRUCTION METHOD THEREFOR

(71) Applicants: Beijing Urban Construction Design&Development Group Co., Limited, Beijing (CN); Fucai Hua, Beijing (CN); Gang Lei, Beijing (CN); Zhihui Yang, Beijing (CN); Zhiyong Zhu, Beijing (CN)

(72) Inventors: Fucai Hua, Beijing (CN); Gang Lei, Beijing (CN); Zhihui Yang, Beijing (CN); Zhiyong Zhu, Beijing (CN); Guangliang Zheng, Beijing (CN); Jianye Zhu, Beijing (CN); Chunxin Hu, Beijing (CN); Endi Chi, Beijing (CN); Chanhong Wang, Beijing (CN); Li Wang, Beijing (CN); Ning Li, Beijing (CN)

(73) Assignees: Beijing Urban Construction Design & Development Group Co., Limited, Beijing (CN); Fucai Hua, Beijing (CN); Gang Lei, Beijing (CN); Zhihui Yang, Beijing (CN); Zhiyong Zhu, Beijing (CN)

( * ) Notice: Subject to any disclaimer, the term of this patent is extended or adjusted under 35 U.S.C. 154(b) by 0 days.

(21) Appl. No.: 18/346,285

(22) Filed: Jul. 3, 2023

(65) Prior Publication Data

US 2024/0003254 A1 Jan. 4, 2024

(51) Int. Cl.
*E21D 9/00* (2006.01)
*E21F 1/04* (2006.01)

(52) U.S. Cl.
CPC . *E21F 1/04* (2013.01); *E21D 9/00* (2013.01)

(58) Field of Classification Search
CPC ..... E21F 1/04; E21D 9/00; B60H 1/00295; B60H 1/00271; B60H 1/00507; B60H 1/0055; B60H 2001/2293
(Continued)

(56) References Cited

U.S. PATENT DOCUMENTS

| | | | |
|---|---|---|---|
| 3,823,654 A | 7/1974 | Swaty | |
| 7,530,765 B2 | 5/2009 | Seo et al. | |
| 10,280,749 B2 | 5/2019 | Chen et al. | |

FOREIGN PATENT DOCUMENTS

| | | | |
|---|---|---|---|
| CN | 100557191 C * 11/2009 | ..... | E21F 1/00 |
| CN | 102953739 A * 3/2013 | ..... | E21D 13/02 |

(Continued)

OTHER PUBLICATIONS

Dexing, Wu, CN100557191 Translation.pdf, "Smoke emission method in tunnel and tunnel ventilation system with separate somke-emission device", Nov. 2009, pp. 1-16.*
Kong, Chuigang, CN102953739 Translation.pdf, "Bidirectional punching method for underground excavation of subway station", Mar. 2013, pp. 1-27.*

(Continued)

*Primary Examiner* — Avinash A Savani
*Assistant Examiner* — Ryan L Faulkner
(74) *Attorney, Agent, or Firm* — True Shepherd LLC; Andrew C. Cheng

(57) ABSTRACT

Combination of an open and a hidden excavation for constructing a vertical orthogonal top exhausting air duct structure of a deeply-buried subway station is provided. Four horizontal air ducts: left and right piston air ducts, an exhaust air duct, and a fresh air duct are thrown out of the underground, respectively, leading to left and right piston air shafts, an exhaust air shaft, a fresh air shaft, and an entrance/exit of fire-fighting. The fourth underground floor is communicated with the hall floor of the station main body, and (Continued)

the fifth underground floor is communicated with the running tunnel and the platform floor of the station main body. During operation, the train will enter and exit the station through the fifth underground floor of the air duct, and the piston air and heat will enter the four transverse air ducts through the air duct main body.

10 Claims, 15 Drawing Sheets

(58) Field of Classification Search
USPC ..... 454/166
See application file for complete search history.

(56) References Cited

FOREIGN PATENT DOCUMENTS

| | | | | | |
|---|---|---|---|---|---|
| CN | 105298501 | A | | 2/2016 | |
| CN | 106948823 | A | | 7/2017 | |
| CN | 108412500 | A | | 8/2018 | |
| CN | 111911184 | A | * | 11/2020 | ..... E21D 9/14 |

OTHER PUBLICATIONS

Wang, Bingzhong, CN111911184 Translation.pdf, "Air duct formed by expanding excavation of multiple layers of temporary construction channels and construction method", Nov. 2020, pp. 1-8.*

* cited by examiner

VERTICAL ORTHOGONAL TOP EXHAUSTING AIR DUCT STRUCTURE OF DEEPLY-BURIED SUBWAY STATION AND CONSTRUCTION METHOD THEREFOR

CROSS-REFERENCE TO RELATED APPLICATIONS

This application claims priority to Chinese Patent Application No. 202210776752.1 with a filing date of Jul. 4, 2022. The content of the aforementioned application, including any intervening amendments thereto, is incorporated herein by reference.

TECHNICAL FIELD

The present disclosure relates to the technical field of urban rail transit designs and constructions, in particular to a vertical orthogonal top exhausting air duct structure of a deeply-buried subway station and a method for constructing the same.

BACKGROUND

As an important component of urban transportation, subways are playing an increasingly positive role in passenger transportation in densely populated cities. Hidden excavated subway stations are usually arranged below urban roads with high traffic volume. The station main body is generally an arched tunnel structure, and its auxiliary structure is thrown out horizontally and transversely of the main body structure and leads to the ground. The segment above the ground is generally arranged outside the road red line. As a typical auxiliary structure, an air duct is usually arranged at both ends of the station, adjacent to the running tunnel, and communicated with the ground through an air shaft, such that the enclosed underground station is connected with the external environment, exchanging the internal air and the external air, and ensuring the freshness and the comfortableness of the air in the station. Generally speaking, in order to improve the ventilation efficiency and achieve the goal of energy conservation and emission reduction, under the condition that sufficient space is available for ensuring the normal operation of the blower, the shorter the air duct, the better the effect. According to the requirements of the latest specification of "Design Standards for Ventilation, Air Conditioning and Heating of Urban Rail Transportation", where fully enclosed shielded doors are used, the length of the piston air duct should not exceed 40 m.

Where it is possible to arrange an air pavilion above the ground directly above a deeply-buried hidden excavated subway station, the design of a throw-out air duct will lose its advantages and expose its shortcomings. On one hand, the throw-out design makes the air duct lengthy, which does not facilitate the exchange of the internal air and the external air; on the other hand, a throw-out design results in a smaller vertical shaft of the air duct and more transverse channel conversions during construction, which lead to high risks, slow slag discharge, and low construction efficiency.

In view of the aforementioned defects, the inventor of the present disclosure devoting himself to research and design, based on years of experience and achievements in related industries, has developed a vertical orthogonal top exhausting air duct structure of a deeply-buried subway station and a method for constructing the same to overcome the aforementioned defects. These technical solutions bring a better utilization of the vertical space above the deeply-buried station, improvement of the ventilation efficiency, reductions of the construction workload and realizations of the concepts of green environmental protections, energy conservations and emission reductions.

SUMMARY

The objective of the present disclosure is to provide a vertical orthogonal top exhausting air duct structure of a deeply-buried subway station and a method for constructing the same, which can effectively shorten the length of the air duct, improve the utilization rate of the space above the deeply-buried station, and can be jointly constructed with the main body structure of the hidden excavated subway station and the running tunnel to improve the efficiency and accelerate the construction duration. The construction method is to construct with a combination of an open excavation and a hidden excavation and be tailored to local conditions. The project cost and the construction sites can be effectively balanced to obtain a maximum output value.

In order to achieve the above objective, the present disclosure discloses a vertical orthogonal top exhausting air duct structure of a deeply-buried subway station, comprising air duct split parts and an air duct main body part.

Each of the air duct split parts is located at its corresponding of the two sides of the air duct main body part, and the air duct split parts and the air duct main body part are constructed simultaneously. The air duct split parts comprise a left piston air shaft, a right piston air shaft, an exhaust air shaft, a fresh air shaft, and partial air duct transverse channels, wherein the partial air duct transverse channels comprise a partial left piston air duct transverse channel, a partial right piston air duct transverse channel, a partial exhaust duct transverse channel and a partial fresh air duct transverse channel. The air duct main body part is divided into a first-stage open excavated foundation pit, a hidden excavated arch cover part, a second-stage open excavated foundation pit, a third-stage open excavated foundation pit, and the remaining air duct transverse channels. The remaining air duct transverse channels comprise a remaining left piston air duct transverse channel, a remaining right piston air duct transverse channel, a remaining exhaust air duct transverse channel, and a remaining fresh air duct transverse channel. The partial left piston air duct transverse channel is communicated with the remaining left piston air duct transverse channel and they form a left piston air duct transverse channel. The partial right piston air duct transverse channel is communicated with the remaining right piston air duct transverse channel and they form a right piston air duct transverse channel, the partial exhaust air duct transverse channel is communicated with the remaining exhaust air duct transverse channel and they form an exhaust air duct transverse channel, and the partial fresh air duct transverse channel is communicated with the remaining fresh air duct transverse channel and they form a fresh air duct transverse channel. The air duct main body is located between a running tunnel and the station main body.

A method for constructing a vertical orthogonal top exhausting air duct of a deeply-buried subway station is also disclosed.

The construction of the air duct split parts comprises the following steps:

Step 1.1: the locking ring beams are constructed at the positions above the ground of the left piston air shaft, the right piston air shaft, the exhaust air shaft, and the fresh air shaft. The foundation embedded parts of the lifting derrick are installed.

Step 1.2: an earthwork excavation for the vertical shafts is carried out, excavating along with supporting.

Step 1.3: the concrete is sprayed for the first time, and grid steel frames and a steel mesh are installed.

Step 1.4: the concrete is sprayed to seal the surrounding rock.

Step 1.5: steps 1.2 to 1.4 are repeated, until it is excavated up to the bottom elevation of the vertical shaft.

Step 1.6: the bottom of the vertical shaft is sealed.

Step 1.7: three grid steel frames are erected jointly at the positions of their respective air duct transverse channels of the left piston air shaft, the right piston air shaft, the exhaust air shaft, and the fresh air shaft. Mortar anchor rods are set.

Step 1.8: the partial left piston air duct transverse channel, the partial right piston air duct transverse channel, the partial exhaust air duct transverse channel, and the partial fresh air duct transverse channel are excavated in full face from the left piston air shaft, the right piston air shaft, the exhaust air shaft, and the fresh air shaft, respectively. Anchor rods are constructed, steel mesh is bound, and the concrete is sprayed.

Step 1.9: a waterproof layer of a bottom plate is laid, and the bottom plate is constructed.

Step 1.10: the remaining waterproof layers are laid, and an arch part and the second lining of the side wall are constructed.

Step 1.11: steps 1.8 to 1.10 are repeated, until the partial piston air duct transverse channels are completed;

The construction of the air duct main body comprises the following steps:

Step 2.1: before the excavation, dewatering inside the pit should be carried out to lower the level of the groundwater to 1 m below the final excavation surface of the foundation pit; an intercepting ditch and hardening of the ground surface should be made on the top of the slope to prevent the surface water from seeping into the bottom of the slope.

Step 2.2: a primary steel pipe pile is set in the rock stratum.

Step 2.3: a crown beam is constructed, knee bracings are arranged, and prestressed anchor rods are set.

Step 2.4: a downward earthwork excavation is carried out. The first-stage open excavated foundation pit is excavated layer by layer from top to bottom. After the excavation, a layer of the concrete is sprayed to seal the surrounding rock. Then the anchor rods are set, a steel mesh is hung, and then a sprayed concrete panel is constructed.

Step 2.5: the first-stage open excavated foundation pit is excavated layer by layer up to the elevation of the support of the arch cover feet, i.e., the top elevation of the initial support of the horizontal transverse channel. The construction of the hidden excavated arch cover part begins.

Step 2.6: an advanced large pipe shed in the open excavated foundation pit is set.

Step 2.7: the shotcrete with a thickness of 100-200 mm or the concrete with a thickness of 200-500 mm is used to seal the tunnel face.

Step 2.8: firstly, the pilot tunnels on both side walls are excavated in sequence, the concrete is sprayed to seal the surrounding rock, grid arch frames are erected, a temporary steel support is erected, a steel mesh is bound, and the concrete is sprayed.

Step 2.9: the loosened soil at the foundation of the grid feet should be removed after each grid arch being erected. A shotcrete cushion layer with a thickness of 100 mm is constructed as the foundation of the grid feet to ensure the stability of the grid.

Step 2.10: the two middle pilot tunnels are excavated with a longitudinal offset of about 5 m. After the excavation, the concrete is sprayed immediately to seal the surrounding rock. Grid arch frames are erected, a temporary steel support is erected, a steel mesh is bound, and the concrete is sprayed.

Step 2.11: an arch cover structure is constructed. The temporary support in the midspan is removed in sections.

Step 2.12: the second-stage foundation pit is excavated under the protection of the arch cover structure.

Step 2.13: after excavating up to the bottom elevation of the air duct transverse channels, the excavation is suspended. The excavation of the ingates on both sides begins to enter the tunnel, and the four remaining partial air duct transverse channels are excavated.

Step 2.14: after the construction of the second lining of the remaining air duct transverse channels being completed, a downward earthwork excavation is continued. The excavated part of the third-stage foundation pit is perpendicularly separated along the outer contour line of the station main body structure from the bottom elevation of the air duct transverse channel.

Step 2.15: the downward excavation is continued within the range of the steel pipe pile, and a support is constructed in time.

Step 2.16: where the pit is excavated to 300 mm above the foundation pit cushion layer, a foundation pit acceptance should be carried out, and the remaining earthwork should be excavated manually. After excavating to the designed elevation, the following actions should be done immediately: the foundation pits are levelled, the accumulated water in the pits is drained, and a cushion layer is constructed in time.

Step 2.17: a hidden excavation construction of the station main body is carried out from the foundation pit of the air duct main body.

Step 2.18: after the station main body structure being hidden excavated in full face and the tunnel being entered, the waterproof layer of the air duct main body structure is laid in time, and then the second lining structure of the air duct main body is constructed in sequence from bottom to top.

Step 2.19: after the concrete second lining structure of the air duct main body reaching 75% of the designed strength, backfill is carried out and the earthwork is tamped to restore the ground.

In step 2.6, to ensure the construction accuracy of the long pipe shed, a guide steel pipe with a diameter of φ140 mm, a wall thickness of 5 mm, L=0.8 m is selected; wherein the long pipe shed covers the whole horizontal depth of the arch cover.

The length of the long pipe shed is 16 m, which is formed by hot-rolled seamless steel pipes with each section having a length of 4 m and being connected by threads. Cement slurry is used for grouting, with a water-cement ratio of 1:1 and a grouting pressure of 0.5-2.0 MPa. After grouting, the steel pipe is filled with cement mortar of M7.5 to enhance the strength of the pipe shed.

In step 2.12, the construction of the second-stage open excavated foundation pit is divided into two parts: one part comes from a continuous downward excavation from the first-stage foundation pit, and the other part comes from a downward covered excavation from the hidden excavated segments under the protection of the arch cover. During construction, the principle of supporting followed by excavating is also adopted. After the excavation, a layer of the concrete is sprayed immediately to seal the surrounding rock. Then the anchor rods are set, a steel mesh is hung. Then a sprayed concrete panel is constructed.

The tunnel entrances of the remaining left piston air duct transverse channel and the remaining fresh air duct transverse channel in step 2.13 are located below the first-stage open excavated foundation pit, and the tunnel entrances of the remaining right piston air duct transverse channel and the remaining exhaust air duct transverse channel are located below the arch cover.

Excavating in full face is used for the remaining left piston air duct transverse channel and the remaining fresh air duct transverse channel below the open excavated foundation pits to enter the tunnel, with specific steps as below:

A. excavating in full face, constructing anchor rods, binding a steel mesh, and spraying the concrete;

B. laying a waterproof layer on a bottom plate and constructing the bottom plate;

C. laying the remaining waterproof layers and constructing an arch part and the second lining of the side wall, wherein the progress of the arch part and the second lining of side wall should be one excavation footage behind the inverted arch of the bottom plate.

The remaining right piston air duct transverse channel and the remaining exhaust air duct transverse channel below the arch cover are excavated using the Center Diaphragm Method, with specific steps as below:

A. excavating the left pilot tunnel, spraying the concrete immediately for the first time to seal the surrounding rock, erecting grid steel arch frames and a vertical temporary steel support of I-type, binding a steel mesh, then spraying the concrete with a thickness of 150 mm;

B. excavating the right pilot tunnel with an offset of 0.5 m, spraying the concrete immediately for the first time to seal the surrounding rock, and erecting grid steel arch frames, wherein the loosened soil at the foundation of the grid feet should be removed after each grid frame being erected, and a shotcrete cushion layer with a thickness of 100 mm is constructed as the foundation of the grid feet to ensure the stability of the grid;

C. after the arch cover reaching the designed strength, removing the temporary steel support of I and constructing the second lining structure of the air duct at the ingates;

D. the length of the ingates segment being about 3 m, wherein the excavation footage should not exceed 0.5 m, and the segments following the ingates are excavated in full face.

The four remaining air duct transverse channels finally converge with the partial transverse channels excavated from the air shafts in the above step 1.11, respectively, to form fully communicated air duct transverse channels.

In step 2.17, the station main body is hidden excavated from the foundation pits of the air duct main body using the three-bench-seven-step method.

From the above content, it can be seen that the vertical orthogonal top exhausting air duct structure of a deeply-buried subway station and the method for constructing the same of the present disclosure bring the following technical effects:

1. The vertical space above the deeply-buried station is effectively utilized, and the utilization rate of the underground space is improved, so that the station structure is more concentrated, and the impacts on the surrounding building environment are reduced.
2. The lengths of the air ducts of the deeply-buried stations are effectively shortened, improving the ventilation efficiency, saving energies and reducing emissions.
3. During the construction, a foundation pit of the air duct main body can serve as a construction vertical shaft for both the station main body and the running tunnels and can be constructed jointly with the station main body and the running tunnels to accelerate the construction progress.
4. The construction plan combining an open excavation and a hidden excavation can reduce the construction sites and provide multiple working threads, greatly improving the construction efficiency, and effectively saving costs, manpower and resources.

The detailed content of the present disclosure can be obtained from the following explanations and accompanying drawings.

DETAILED DESCRIPTION

Figure 1:
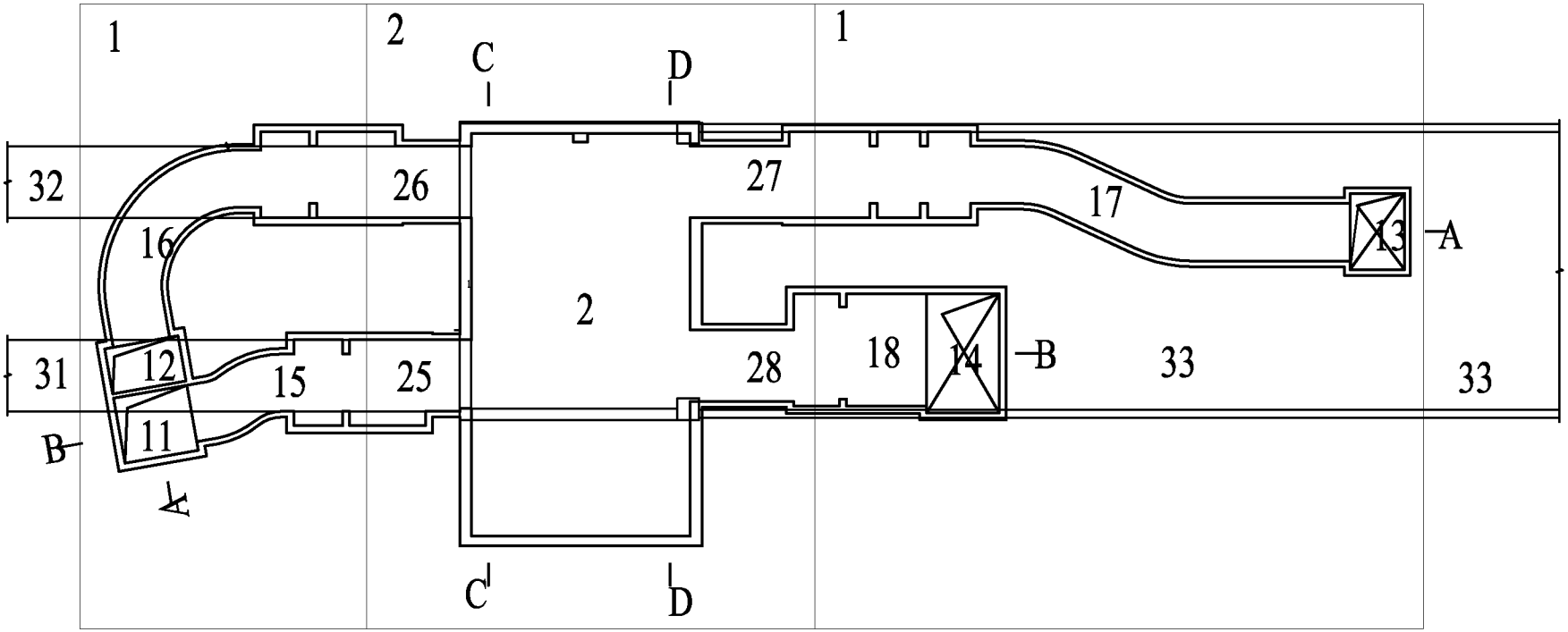
FIG. 1 shows an overall layout of a vertical orthogonal top exhausting air duct structure of a deeply-buried subway station of the present disclosure.

Referring to FIGS. 1-5, a vertical orthogonal top exhausting air duct structure of a deeply-buried subway station of the present disclosure is shown.

The vertical orthogonal top exhausting air duct structure of the deeply-buried subway station and a method for constructing the same comprise:

As shown in FIGS. 1-5, a top exhausting air duct structure suitable for a deeply-buried and hidden excavated subway station provided by the present disclosure comprises air duct split parts 1 and an air duct main body part 2. An air duct split part 1 is located at its corresponding one of the two sides of the air duct main body part 2. The air duct split parts 1 and the air duct main body part 2 can be constructed simultaneously to reduce the construction duration. The air duct split parts 1 comprise a left piston air shaft 11, a right piston air shaft 12, an exhaust air shaft 13, a fresh air shaft 14, and partial air duct transverse channels, wherein the partial air duct transverse channels comprise a partial left piston air duct transverse channel 15, a partial right piston air duct transverse channel 16, a partial exhaust air duct transverse channel 17, and a partial fresh air duct transverse channel 18. Based on the construction process, the air duct main body part 2 can be divided into four parts, i.e., a first-stage open excavated foundation pit 21, hidden excavated arch cover parts 22, second-stage open excavated foundation pits 23, a third-stage open excavated foundation pit 24, and the remaining air duct transverse channels, wherein the remaining partial air duct transverse channels comprise a remaining left piston air duct transverse channel 25, a remaining right piston air duct transverse channel 26, a remaining exhaust air duct transverse channel 27, and a remaining fresh air duct transverse channel 28. The partial left piston air duct transverse channel 15 is communicated with the remaining left piston air duct transverse channel 25 and they form a left piston air duct transverse channel. The partial right piston air duct transverse channel 16 is communicated with the remaining right piston air duct transverse channel 26 and they form a right piston air duct transverse channel. The partial exhaust air duct transverse channel 17 is communicated with the remaining exhaust air duct transverse channel 27 and they form a exhaust air duct transverse channel. The partial fresh air duct transverse channel 18 is communicated with the remaining fresh air duct transverse channel 28 and they form a fresh air duct transverse channel. The air duct main body part 2 is located between the left and right running tunnels 31, 32 and the station main body part 33. After the air duct is put into use, the piston air brought by the train from the running tunnel (the station) to the station (the running tunnel) will enter the piston air duct transverse channels from the air duct main body and then circulate with the air of the external environment through the piston air shafts.

Figure 2:
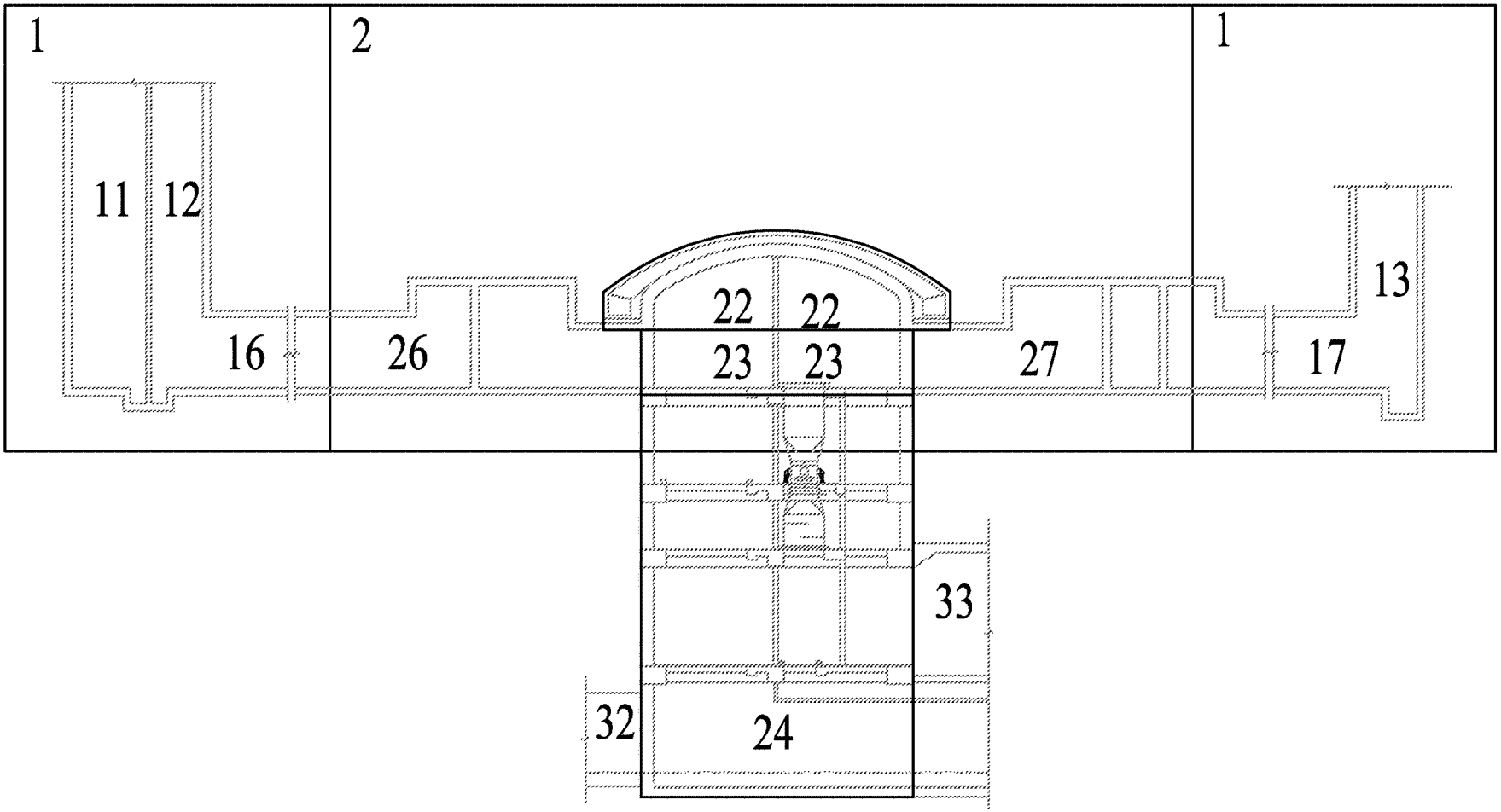
FIG. 2 shows a cross-sectional view of the air duct taken along the line A-A shown in FIG. 1.
Figure 3:
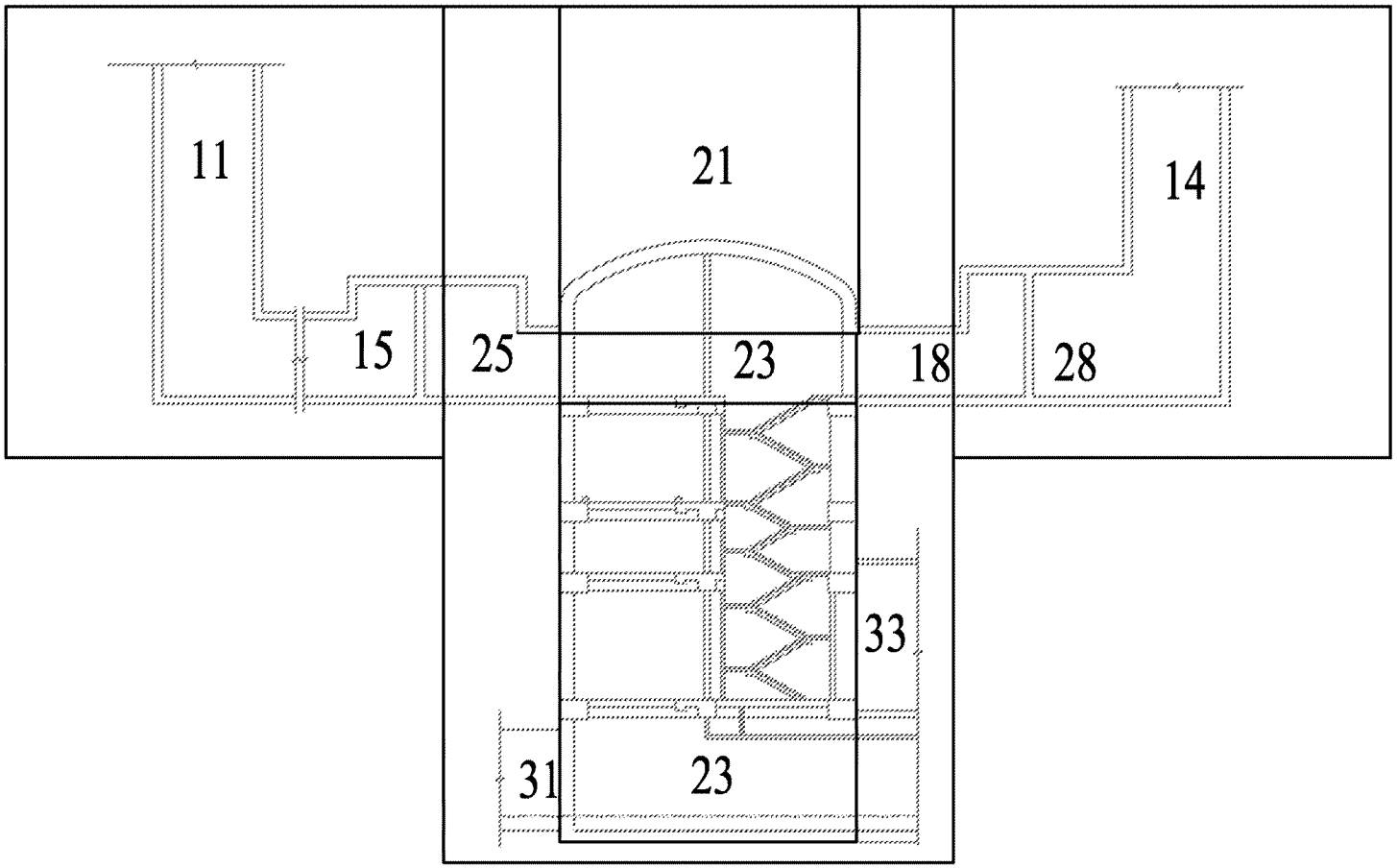
FIG. 3 shows a cross-sectional view of the air duct taken along the line B-B in FIG. 1.
Figure 4:
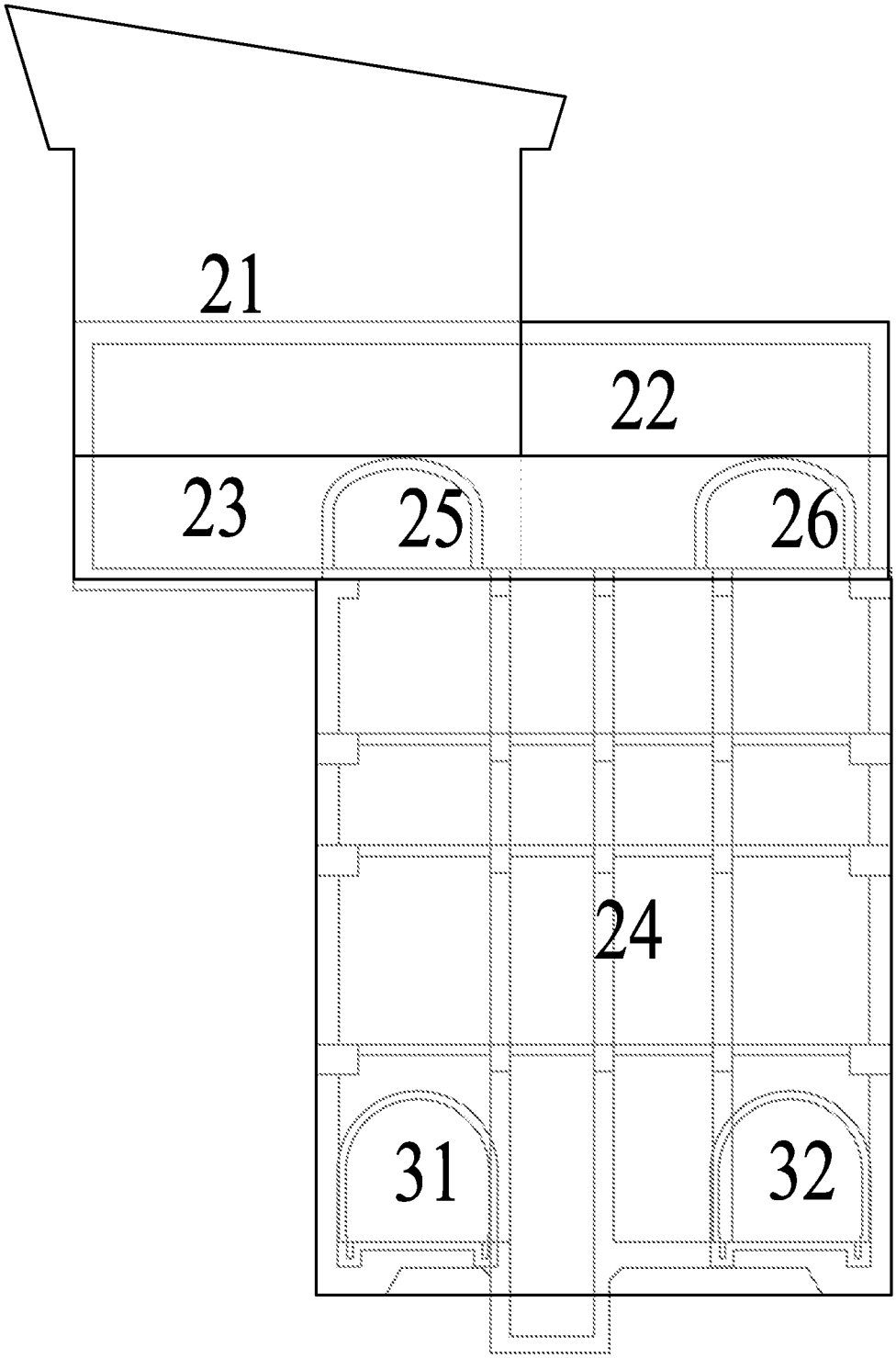
FIG. 4 shows a cross-sectional view of the air duct taken along the lines C-C and A-A shown in FIG. 1.
Figure 5:
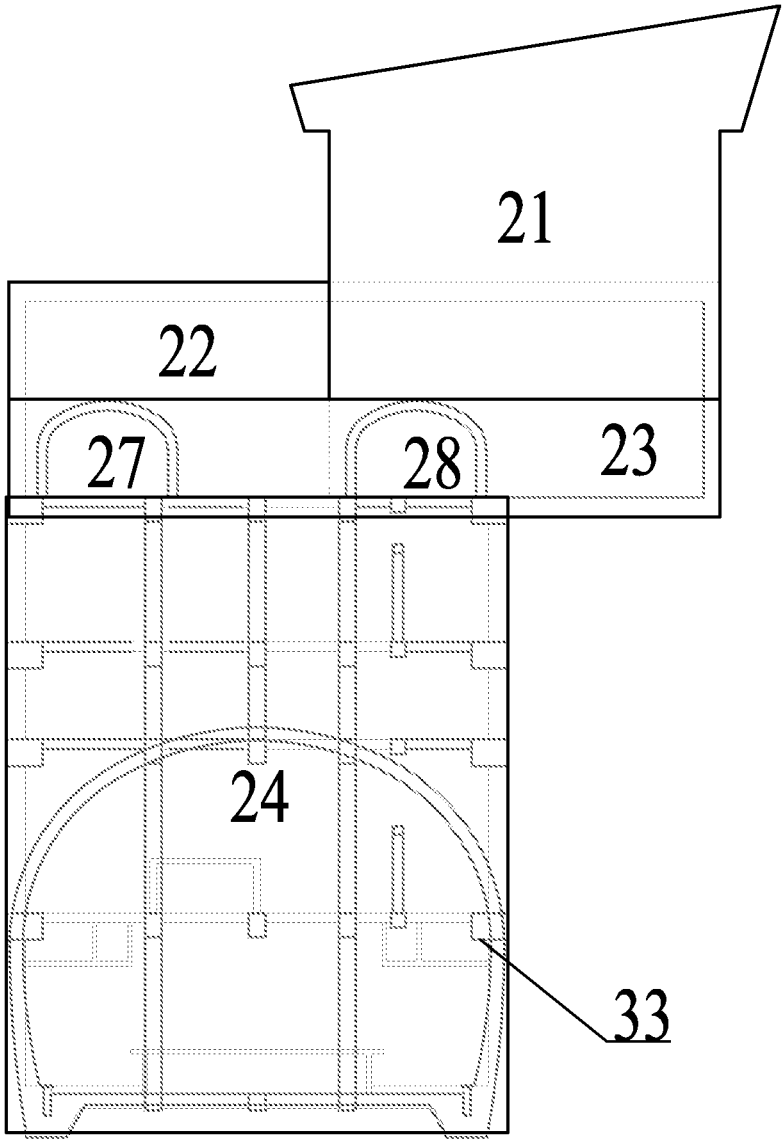
FIG. 5 shows a cross-sectional view of the air duct taken along the lines D-D and A-A shown in FIG. 1.
Figure 6A:
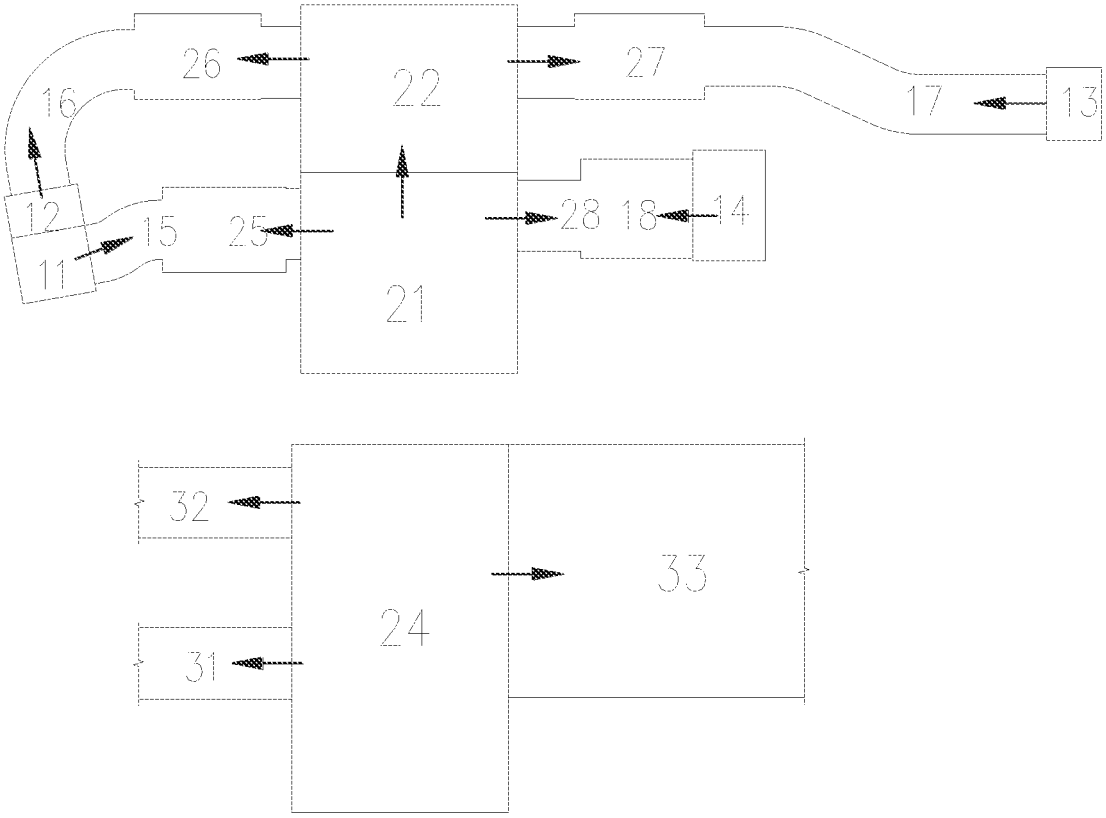
FIGS. 6A and 6B show a construction plan diagram of the present disclosure.
Figure 6B:
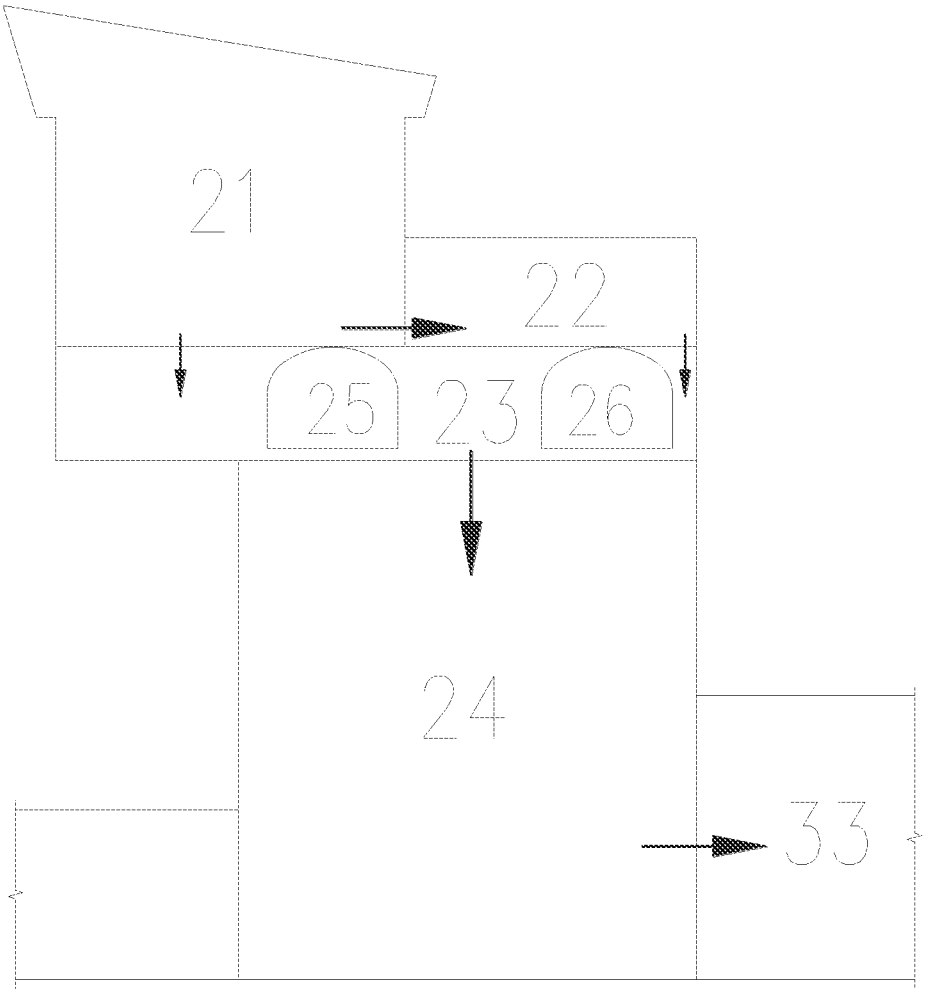

The station main body part 33 is communicated with the third-stage open excavated foundation pit 24 in a way of communication shown in FIGS. 2, 3, and 5. The left and right running tunnels 31, 32 are communicated with the third-stage open excavated foundation pit 24 in a way of communication shown in FIGS. 2, 3, and 4. After the station is put into use, the train enters the air duct main body 2 through the right running tunnel 32 and then enters the station main body 33, realizing the train's entrance to the station; and the train enters the air duct main body 2 through the station main body 33 and then enters the right running tunnel 32, realizing the train's exit from the station. The piston wind brought by the high-speed movement of the train will be carried by the train and enter the air duct main body 2 and then enter the left and right piston air shafts 11, 12 through the left and right piston air ducts 25, 15 and 26, 16, thereby realizing a wind pressure balance between the external environment and the internal environment of the subway track area. The turbid gas inside the station main body enters the exhaust air ducts 27, 17 through the ventilation pipelines of the station main body 33 and the air duct main body 2, leads to the exhaust air shaft 13 and then is discharged into the external environment. The fresh air from the outside enters the fresh air ducts 18, 28 through the fresh air shaft 14, then it enters the air duct main body 2, and it finally enters the station main body 33, so as to realize the gas exchange between the non-track area of the station and the external environment, and ensure the freshness of the air within the station.

The present disclosure also discloses a method for constructing the above vertical orthogonal top exhausting air duct of a deeply-buried subway station, comprising the following steps:

Referring to FIGS. 4-6A and FIG. 6B, the construction of the air duct split parts 1 comprises the following steps:

Step 1.1: the locking ring beams are constructed at the positions above the ground of the left piston air shaft 11, the right piston air shaft 12, the exhaust air shaft 13, and the fresh air shaft 14. The foundation embedded parts of the lifting derrick may be installed.

Step 1.2: an earthwork excavation for the vertical shafts is carried out, excavating along with supporting. The vertical shafts are excavated in layers from top to bottom, with the excavation step spacing being the spacing between the grid steel frames. In this embodiment, a hollow grouting anchor rod with a diameter of ϕ25 is used in the joint development zone, with a setting length of L=2.5 m and a setting angle of 15°, wherein the left piston air shaft 11 and the right piston air shaft 12 can be excavated together as the same vertical shaft, while the exhaust air shaft 13 and the fresh air shaft 14 can be excavated as two vertical shafts simultaneously.

Step 1.3: the concrete is sprayed for the first time, and grid steel frames and a steel mesh are installed. Before installation, the clearance should be checked to prevent under excavation. Preferably, in this embodiment, wherever the surrounding rock conditions are good, a steel mesh of ϕ6200 mm*200 mm can be used for spraying the shotcrete without installing grid steel frames.

Step 1.4: the concrete is sprayed to seal the surrounding rock. While spraying the concrete, attention should be paid to the control of the wind pressure (0.1-0.2 MPa) to avoid excessive rebound of the sprayed concrete due to excessive wind pressure. The nozzle should be perpendicular to the surface to be sprayed, and the distance should not be greater than 1.5 m. The spraying of the concrete should be carried out in layers from bottom to top.

Step 1.5: steps 1.2 to 1.4 are repeated, until it is excavated up to the bottom elevation of the vertical shaft.

Step 1.6: the bottom of the vertical shaft is sealed.

Step 1.7: three grid steel frames are erected jointly at the positions of their respective air duct transverse channels of the left piston air shaft 11, the right piston air shaft 12, the exhaust air shaft 13, and the fresh air shaft 14. Mortar anchor rods with a dimeter of Φ28 are set, with a length of 4 m, and an angle of 15°.

step 1.8: the partial left piston air duct transverse channel 15, the partial right piston air duct transverse channel 16, the partial exhaust air duct transverse channel 17, and the partial fresh air duct transverse channel 18 are excavated in full face from the left piston air shaft 11, the right piston air shaft 12, the exhaust air shaft 13, and the fresh air shaft 14, respectively. Anchor rods are constructed, a steel mesh is bound, and the concrete is sprayed.

step 1.9: a waterproof layer of a bottom plate is laid, and the bottom plate is constructed.

step 1.10: the remaining waterproof layers are laid, and an arch part and the second lining of side wall are constructed. The progress of the arch and the second lining of the side wall should be one excavation footage behind the inverted arch of the bottom plate.

step 1.11: steps 1.8 to 1.10 are repeated, until all of the partial left piston air duct transverse channel 15, the partial right piston air duct transverse channel 16, the partial exhaust air duct transverse channel 17, and the partial fresh air duct transverse channel 18 are completed and converged with the transverse channels of the air duct main body part 2.

Figure 7A:
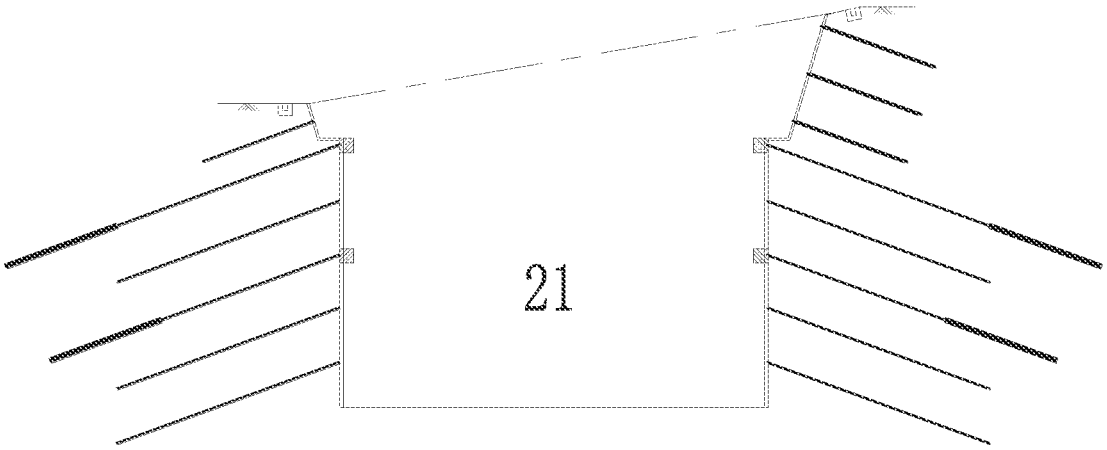
FIGS. 7A, 7B, 7C, 7D, 7E, 7F, 7G, and 7H show the schematic diagrams of the construction of the air duct main body in the present disclosure.

Referring to FIGS. 5, 7A-7H, and 8, the construction of the air duct main body part 2 comprises the following steps:

Step 2.1: referring to FIG. 7A, in one embodiment, due to the great elevation difference of the terrains, sloping treatment can be carried out above the foundation pits and a soil nailing wall support can be used. Before the excavation, dewatering inside the pits should be carried out to lower the level of the groundwater to 1 m below the final excavation surface of the foundation pits; an intercepting ditch and hardening of the ground surface should be made on the top of the side slope to prevent the surface water from seeping into the bottom of the slope.

Step 2.2: a primary steel pipe pile is set in the rock stratum. In this embodiment, no steel pipe pile is installed due to the deep foundation pit. A controlled smooth blasting is used for the earthwork excavation, and a manual excavation is used instead at a distance of 3 meters away from the designed slope wall. Multiple measurements are required during construction to prevent over excavation and under excavation.

Step 2.3: a crown beam is constructed, knee bracings are arranged, and prestressed anchor rods are set.

Step 2.4: a downward earthwork excavation is carried out and a support is constructed in time. The first-stage open excavated foundation pit 21 is excavated layer by layer from top to bottom, with the excavation step spacing being the spacing between the anchor rods. Over excavation is strictly prohibited. After the excavation, a layer of the concrete is sprayed immediately to seal the surrounding rock. Then the anchor rods are set, a steel mesh is hung, and then a sprayed concrete panel is constructed.

Step 2.5: the first-stage open excavated foundation pit 21 is excavated layer by layer up to the bottom elevation of the support of the arch cover feet, i.e., the top elevation of the initial support of the horizontal transverse channel. The construction of the first-stage open excavated foundation pit 21 is suspended and the construction of the hidden excavated arch cover part 22 begins.

Step 2.6: an advanced large pipe shed in the open excavated foundation pit is set. To ensure the construction accuracy of a long pipe shed, a guide steel pipe with a diameter of $\phi$140 mm, a wall thickness of 5 mm, L=0.8 m can be installed. The long pipe shed should cover the whole horizontal depth of the arch cover. In this embodiment, the length of the arch cover is 14.5 m, thus a long pipe shed of 16 m is selected, which is formed by hot-rolled seamless steel pipe (with a diameter of 108 mm, a pipe wall thickness of 6 mm) with each section having a length of 4 m and being connected by threads. Cement slurry is used for grouting, with a water-cement ratio of 1:1 and a grouting pressure of 0.5-2.0 MPa. After grouting, the steel pipe is filled with cement mortar of M7.5 to enhance the strength of the pipe shed.

Step 2.7: depending on the surrounding rock conditions, shotcrete with a thickness of 100-200 mm or concrete with a thickness of 200-500 mm is used to seal the tunnel face, to prevent the tunnel face from being unstable.

Figure 7B:
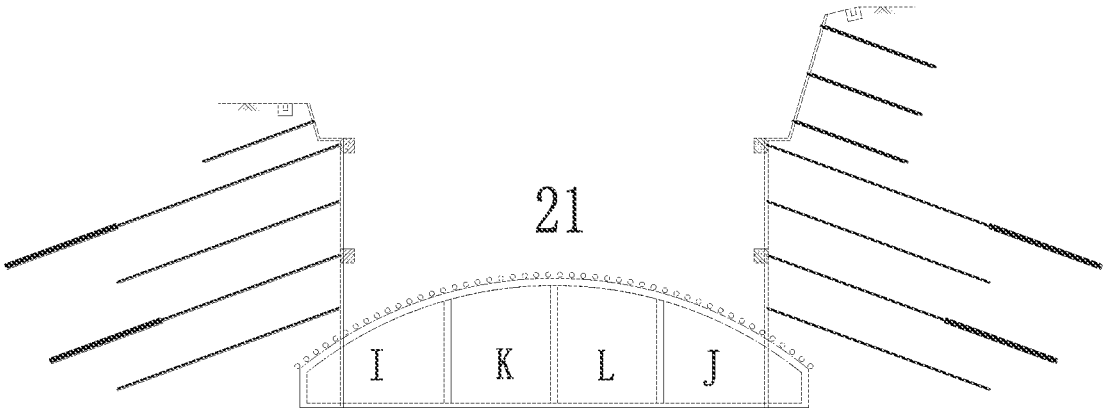

Step 2.8: as shown in FIG. 7B, because of the large span of the tunnel face, the stress situation at the junction of the open excavated foundation pit and the hidden excavated part is complex. Therefore, preferably, the hidden excavated arch cover part is excavated in segments. Firstly, the pilot tunnels I and J on both side walls may be excavated in sequence. Then the concrete of C25 is sprayed immediately to seal the surrounding rock. Grid arch frames are erected, a temporary steel support is erected, a steel mesh is bound, and the concrete is sprayed.

Step 2.9: the loosened soil at the foundation of the grid feet should be removed after each grid arch being erected. A shotcrete cushion layer with a thickness of 100 is constructed as the foundation of the grid feet to ensure the stability of the grid. A reliable wooden plate cushion layer may also be constructed wherever necessary.

Step 2.10: the two middle pilot tunnels K and L are excavated with a longitudinal offset of about 5 m. After the excavation, the concrete of C25 is sprayed immediately to seal the surrounding rock. Grid arch frames are erected, temporary steel supports are erected, a steel mesh is bound, and the concrete is sprayed.

Figure 7C:
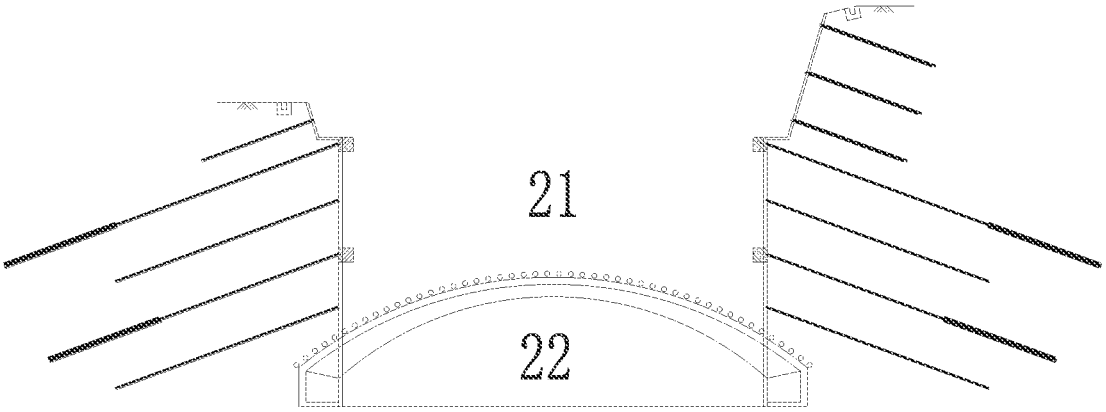

Step 2.11: as shown in FIG. 7C, an arch cover structure is constructed. The temporary support in the midspan is removed in sections. During the removal of the supports, monitoring and measurements should be strengthened. The construction should be guided according to the feedback on the basis of the monitoring results. The lengths of the segments of the support to be removed should be adjusted in time to ensure the safety of the arch. The construction of large arches should be shaped in one time and should not be perfused separately.

Figure 7D:
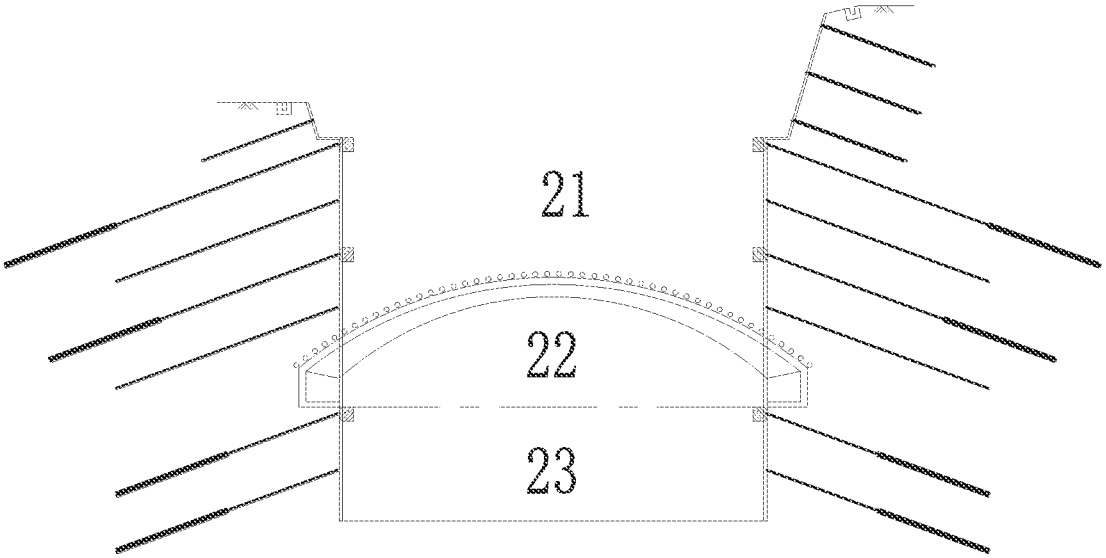

Step 2.12: as shown in FIG. 7D, the second-stage foundation pit 23 is excavated under the protection of the arch cover structure. The second-stage open excavated foundation pit is divided into two parts: one part comes from a continuous downward excavation from the first-stage foundation pit, and the other part comes from a downward covered excavation from the hidden excavated segments under the protection of the arch cover. During construction, the principle of supporting followed by excavating is also adopted. After the excavation, a layer of the concrete is sprayed immediately to seal the surrounding rock. Then anchor rods are set, a steel mesh is hung. Then a sprayed concrete panel is constructed. Only when the supporting strength meets the designed requirements, can the excavation be continued.

Figure 7E:
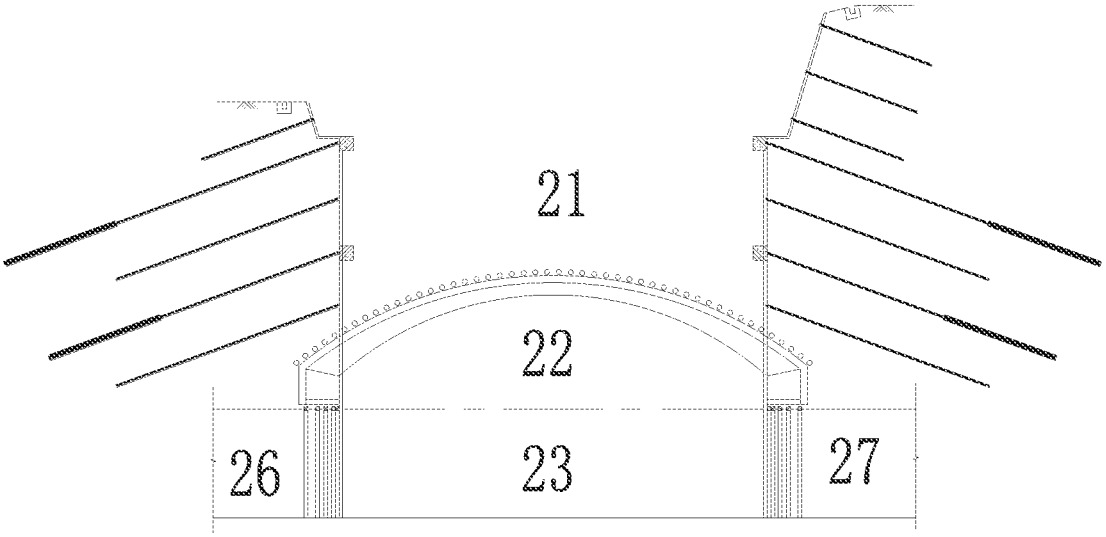

Step 2.13: as shown in FIG. 7E, after excavating up to the bottom elevation of the air duct transverse channels, the excavation is suspended. The excavation of the ingates on both sides begins to enter the tunnel, and the four remaining partial air duct transverse channels are excavated.

Step 2.13 may comprise the following key points:

1. Among the four remaining partial air duct transverse channels, the remaining partial air duct transverse channels comprise the remaining left piston air duct transverse channel 25 and the remaining fresh air duct transverse channel 28 whose tunnel entrances are located below the first-stage open excavated foundation pit, and the remaining right piston air duct transverse channel 26 and the remaining exhaust air duct transverse channel 27 whose tunnel entrances are located below the arch cover, such that the disturbances to the arch cover structure are reduced and the construction safety is ensured. Therefore, the two types of the transverse channels adopt different ways of excavation.

2. Excavating in full face is used for the remaining left piston air duct transverse channel 25 and the remaining fresh air duct transverse channel 28 below the open excavated foundation pits, with specific steps as below:

A. excavating in full face, constructing anchor rods, binding a steel mesh, and spraying the concrete;

B. laying a waterproof layer on a bottom plate and constructing the bottom plate;

C. laying the remaining waterproof layers, constructing an arch part and the second lining of the side wall; wherein the progress of the arch part and the second lining of the side wall should be one excavation footage behind the inverted arch of the bottom plate.

3. The remaining right piston air duct transverse channel 26 and the remaining exhaust air duct transverse channel 27 below the arch cover are excavated using the Center Diaphragm Method (CD method), with specific steps as below:

A. excavating the left pilot tunnel, spraying the concrete immediately for the first time to seal the surrounding rock, erecting grid steel arch frames with φ25 and a vertical temporary steel support of I-22, binding a steel mesh, then spraying the concrete with a thickness of 150 mm;

B. excavating the right pilot tunnel with an offset of 0.5 m, spraying the concrete immediately for the first time to seal the surrounding rock, and erecting grid steel arch frames, wherein the loosened soil at the foundation of the grid feet should be removed after each grid frame being erected, and a shotcrete cushion layer with a thickness of 100 mm is constructed as the foundation of the grid feet to ensure the stability of the grid;

C. removing the temporary steel support of I-22 after the arch cover reaching the designed strength, and constructing the second lining structure of the air duct at the ingates;

D. the length of the ingate segment being about 3 m, wherein the excavation footage should not exceed 0.5 m, the segments following the ingate are excavated in full face, with the steps described in the above key point 2.

4. The four remaining air duct transverse channels finally converge with the partial transverse channels excavated from the air shafts in the above step 1.11, respectively, to form fully communicated air duct transverse channels. Where the tunnel faces of the two construction parties approach each other, one party should stop the construction and the other party should continue the excavation.

Step 2.14: after the construction of the second lining construction of the remaining air duct transverse channels being completed, a downward earthwork excavation is continued. The excavation part of the third-stage foundation pit 24 is perpendicularly separated along the outer contour line of the station main body structure from the bottom elevation of the air duct transverse channel. The second-stage foundation pit, which does not overlap with the contour of the station main body along a perpendicular direction, is sealed at the bottom with the concrete of C20 with a thickness of 200 mm.

Figure 7F:
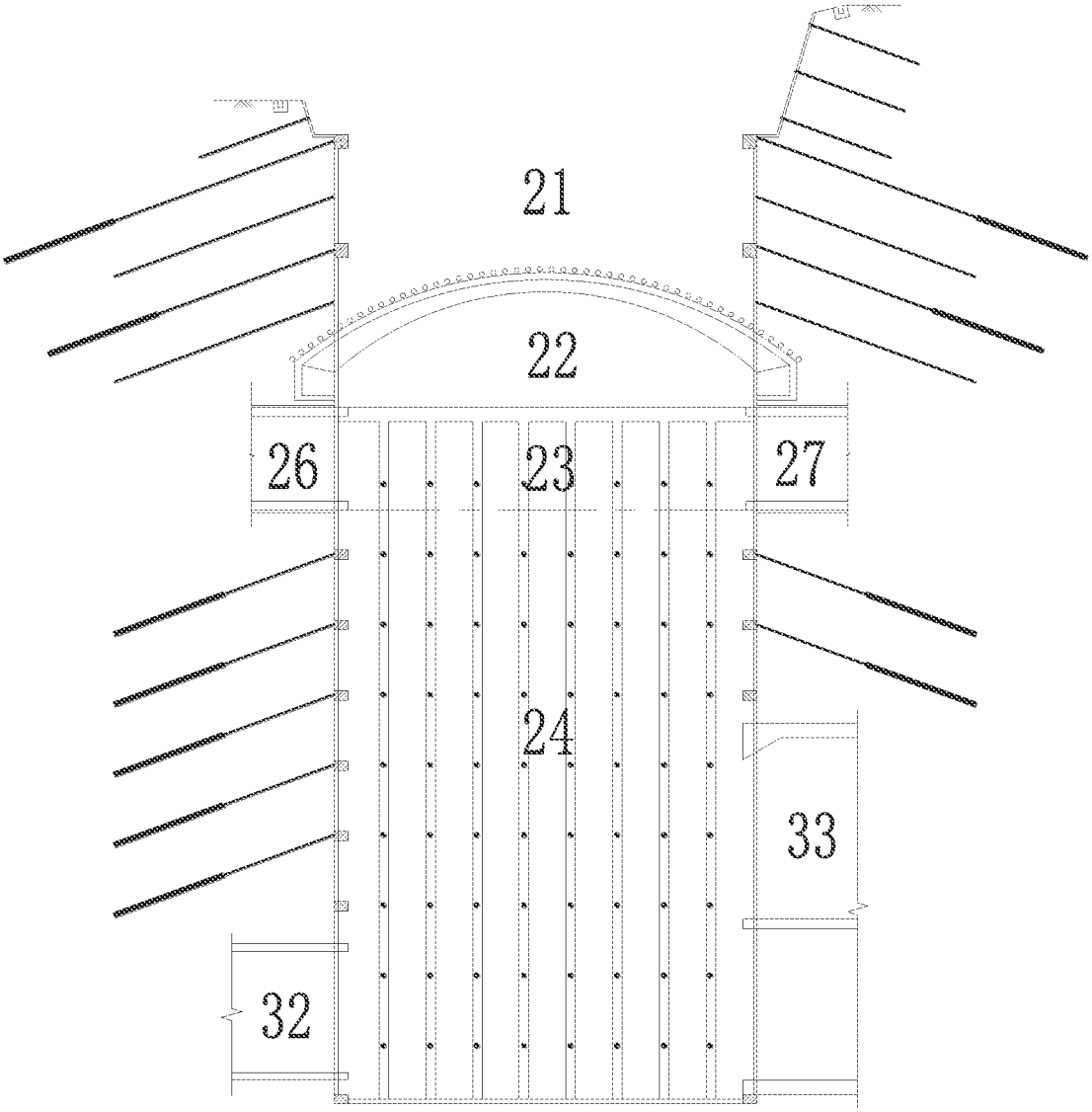

Step 2.15: as shown in FIG. 7F, the downward excavation is continued within the range of the steel pipe pile and a support is constructed in time. The excavation of the foundation pits should be carried out in layers from top to bottom, and the excavation height should be strictly controlled. The construction length of each segment should be the vertical spacing between the rib beams. After excavating up to the designed elevation, a mesh is hung, the shotcrete is sprayed in time, the prestressed anchor cables are set, and the rib beams or columns are constructed, so as to reduce the exposure time of the foundation pits without being supported. For the construction segments having the same level, construction should be carried out from high to low on the rock layer. It is strictly prohibited to over excavate the earthwork in lower layers before the support meets the requirement for normal use.

Step 2.16: where the pits are excavated to 300 mm above the foundation pit cushion layers, a foundation pit acceptance should be carried out, and the remaining earthwork should be excavated manually. After excavating to the designed elevation, the following actions should be done immediately: the foundation pits are levelled, the accumulated water in the pits is drained, and cushion layers are constructed in time.

Figure 8:
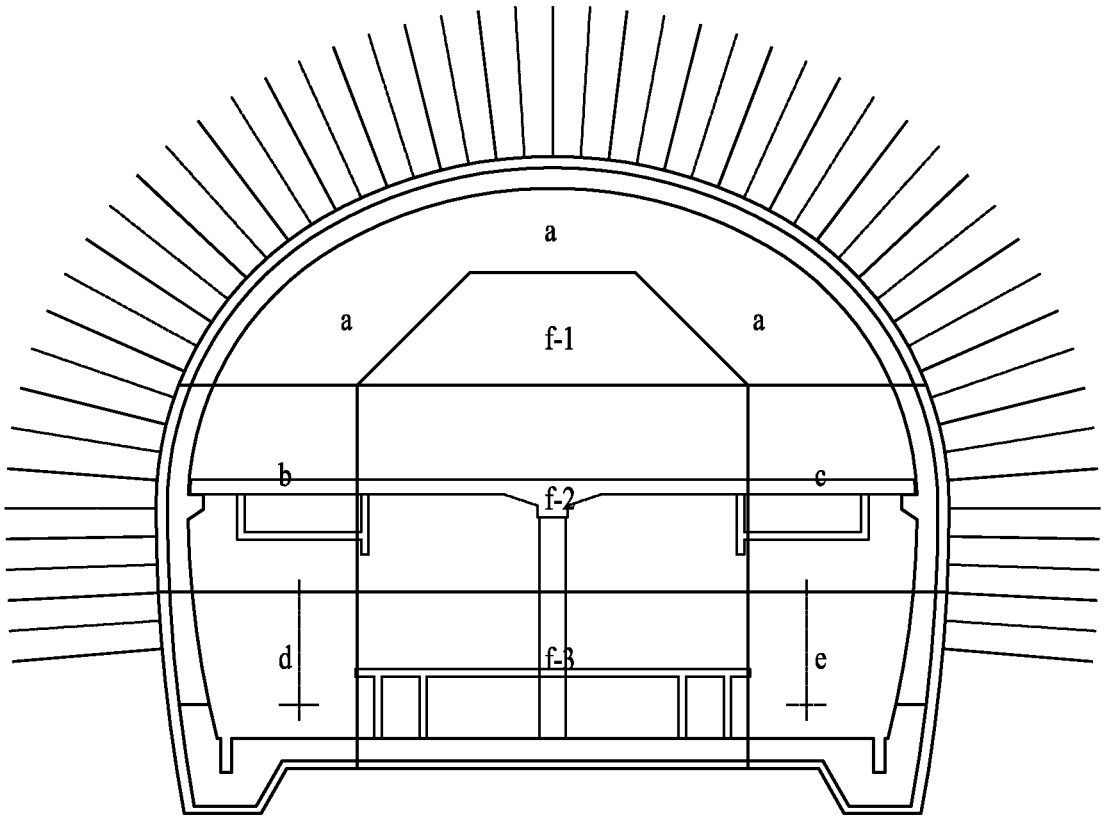
FIG. 8 shows a schematic diagram of the construction of the station main body for entering the tunnel in the present disclosure.
Figure 9:
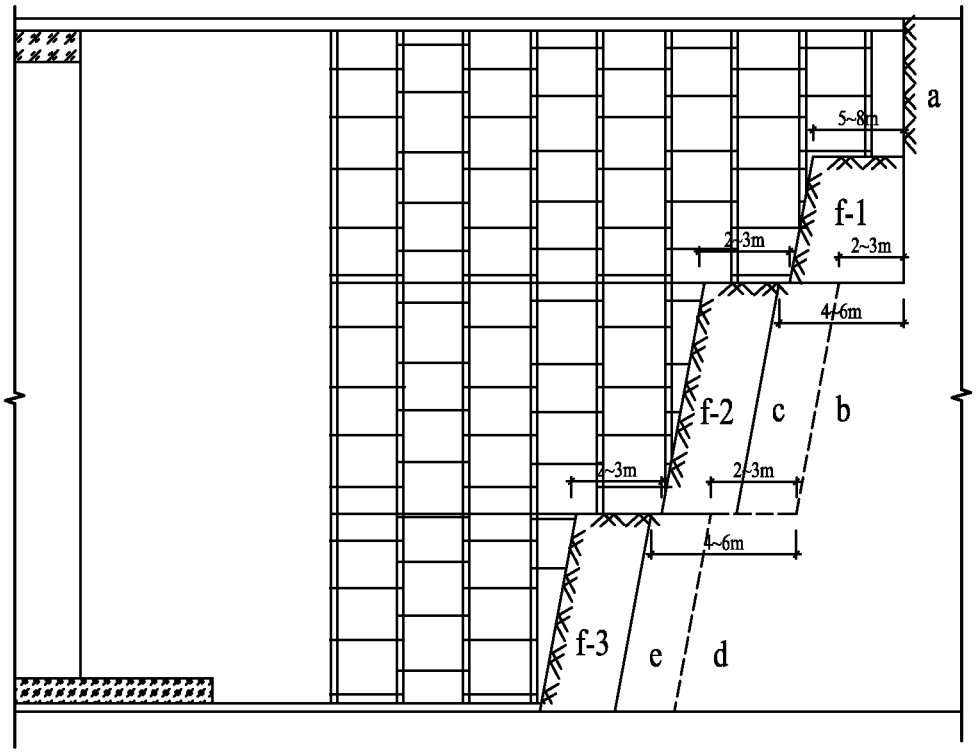
FIG. 9 shows an excavation schematic diagram of the pilot tunnel in the present disclosure.

Step 2.17: using a foundation pit of the air duct main body as a construction vertical shaft for both the station main body and the running tunnel, which can improve the efficiencies of slag transportation and slag removal. For the running tunnels excavated with the shield tunneling, the foundation pits of the air duct main body can facilitate the lifting of the shield tunneling machine. To realize the described function, as shown in FIG. 8, the following steps should be taken for the hidden excavation of the station main body from the foundation pits of the air duct main body:

1. Determining the grade of the surrounding rock, and determining the support plan and the hidden excavation method, wherein in this embodiment, the grade of the surrounding rock of the entrance tunnel of the station main body is Class II, so no advanced support measure is provided. The three-bench-seven-step method is used for the excavation, as shown in FIG. 8;
2. Excavating the upper arc pilot tunnel a, wherein after the excavation, the concrete is sprayed for the first time immediately to seal the surrounding rock, anchor rods are set, grid steel frames are erected, the shotcrete is sprayed again to complete the initial support of the upper arc pilot tunnel a;
3. Excavating the benches of the pilot tunnels b, c on both sides of the middle part, and constructing the initial support for this part;
4. Excavating the benches of the pilot tunnels d, e on both sides of the lower part, and constructing the initial support, wherein the benches of the arc-shaped pilot tunnel, the pilot tunnels on both sides of the middle part, and the pilot tunnels on both sides of the lower part are 2-3 m behind the previous bench in sequence, as shown in FIG. 9;
5. Excavating the core soil f-1, f-2, and f-3 in the upper, middle, and lower parts, which falling behind by 5-8 m in sequence;
6. Constructing a floor layer, laying a waterproof layer, and constructing a second lining floor; and
7. Constructing the second lining of the arch wall.

Figure 7G:
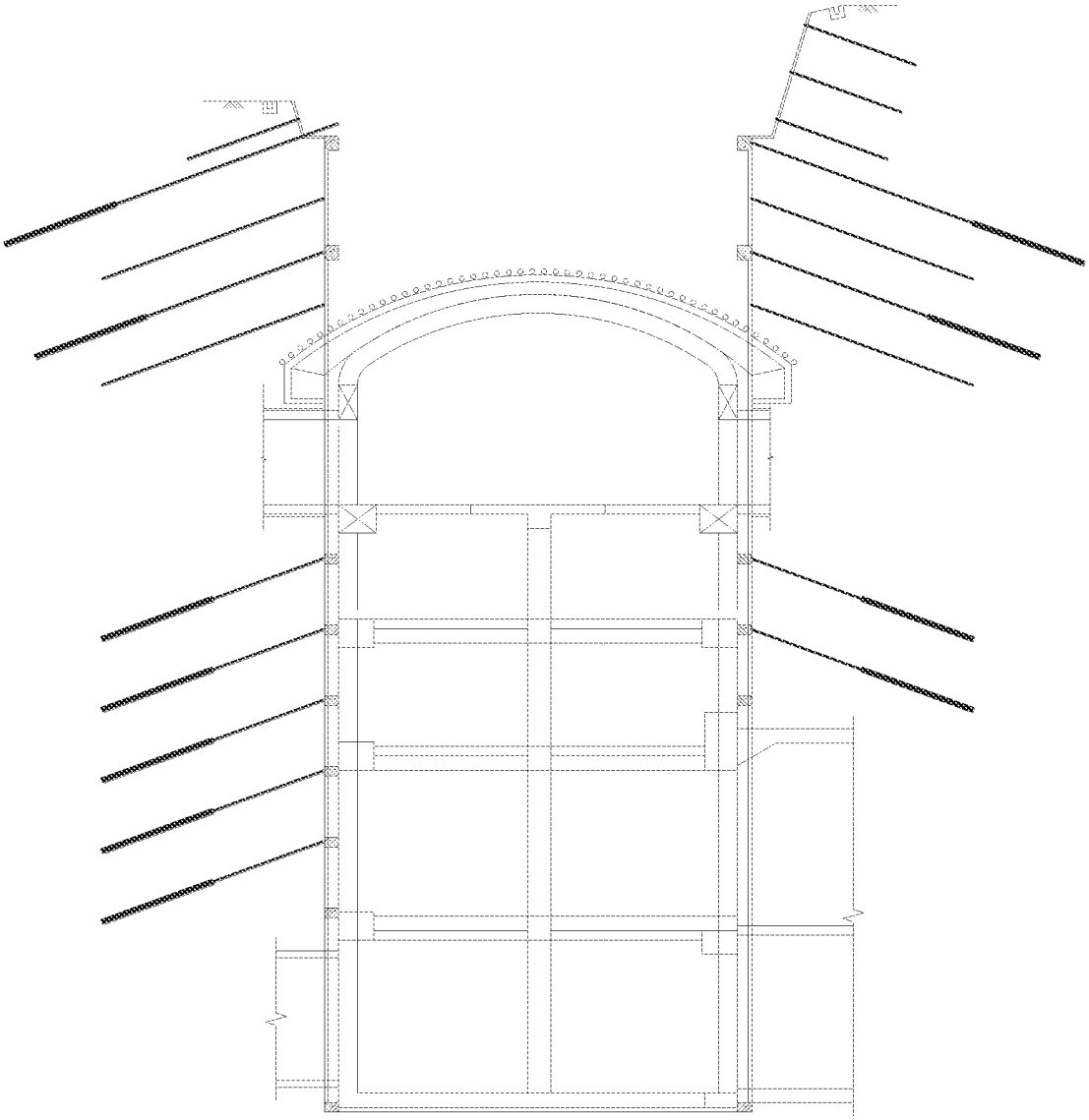

Step 2.18: as shown in FIG. 7G, after the station main body structure is hidden excavated in full face and the tunnel is entered, the waterproof layer of the air duct main body structure is laid in time, and then the second lining structure of the air duct main body is constructed in sequence from bottom to top.

Figure 7H:
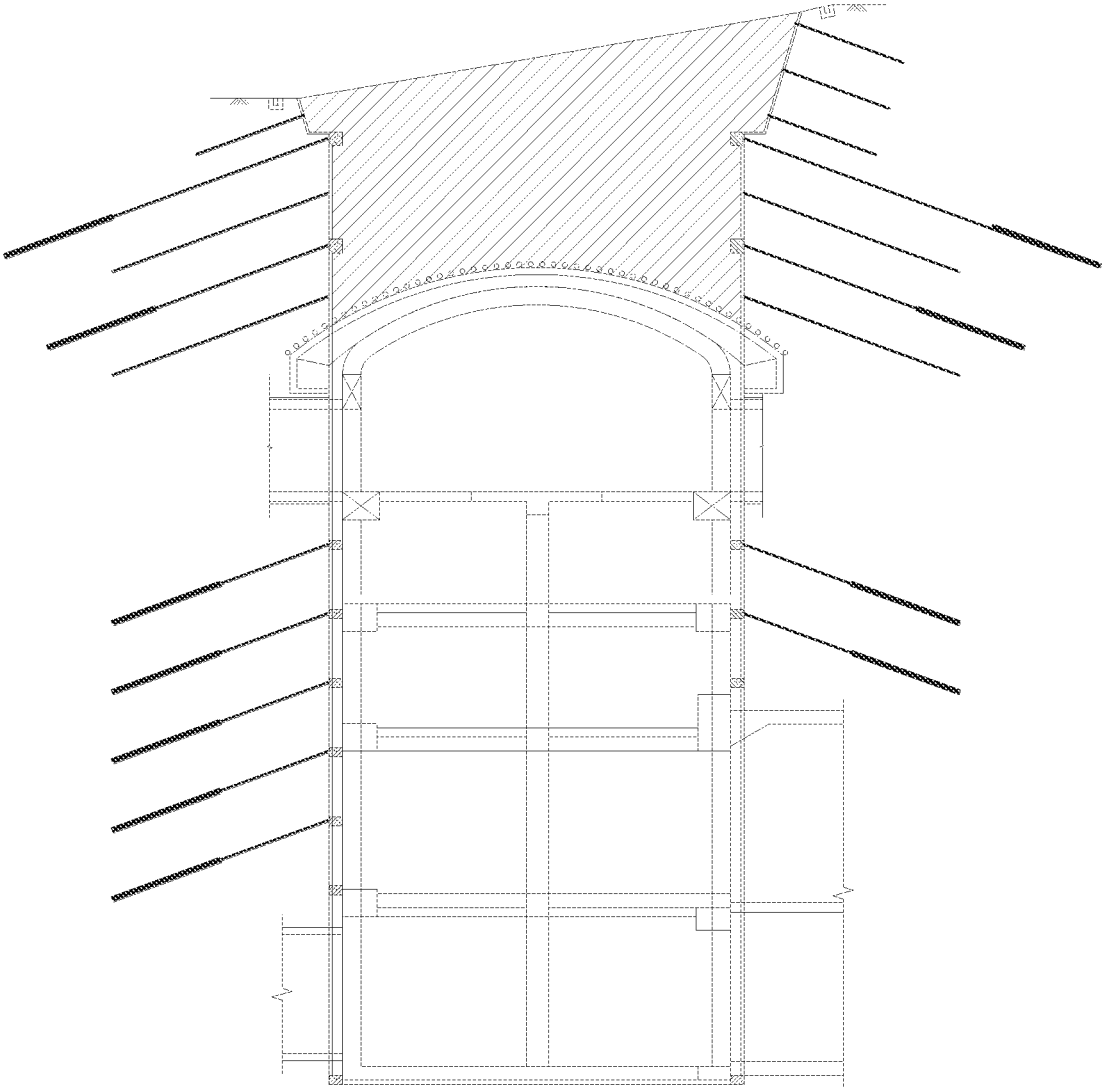

Step 2.19, referring to FIG. 7H, after the concrete second lining structure of the air duct main body reaching 75% of the designed strength, backfill is carried out and the earthwork is tamped to restore the ground.

The air duct main body and the segments above the ground are comprised. The segments above the ground comprise a left piston air duct, a right piston air duct, a fresh air duct, an exhaust air duct, a left piston air shaft, a right piston air shaft, an exhaust air shaft, a fresh air shaft, and an entrance/exit for fire-fighting. The piston air shafts, the exhaust air shafts, the fresh air shafts, and the entrance/exit for fire-fighting are constructed using the inverted hanging shaft wall method. After the piston air ducts, the fresh air ducts, and the exhaust air ducts pass the bottom of the air shafts and the tunnel is entered by excavating an ingate for the main body, a hidden excavation is used for construction.

The air duct main body part is an underground five-story structure, which can be constructed using the open excavation method. Considering the possibility of insufficient reserve space for the ground construction, it is suggested to use a combination of an open excavation and a hidden excavation for constructions in the present disclosure. The first underground floor adopts a combination of an open excavation and a hidden excavation, wherein four horizontal air ducts, i.e., the left and right piston air ducts, the exhaust air duct, and the fresh air duct, which are thrown out of the first underground floor and respectively lead to the left and right piston air shafts, the exhaust air shaft, the fresh air shaft, and the entrance/exit of firefighting, respectively. The second to the fifth underground floors are the second-stage open excavated parts. The fourth underground floor is connected with the floor where the hall of the station main body locates, and the fifth underground floor is connected with the running tunnels and the floor where the platform of the station main body locates. During travelling, the train will enter and exit the station through the fifth underground floor of the air duct, and the piston air and heat brought by it will enter the four horizontal air ducts through the air duct main body, and be transmitted to the external environment through the four air shafts.

Because the top exhausting air duct main body is located between the running parts and the station main body, in the overall construction planning, the open excavated foundation pit of the air duct main body can serve as a mucking vertical shaft or a starting and receiving shaft of a shield which are required for the station main body and the running tunnels. Compared to constructing temporary vertical and inclined shafts, the foundation pits are on a larger scale and fewer turning points are needed, which makes it easier for construction. Thus, the construction progress can be accelerated and the construction duration can be reduced. In addition, as an auxiliary structure of the station, the air ducts do not need to be backfilled later. Better economic benefits are obtained.

It is obvious that the above descriptions and documentations are only examples and not intended to limit the disclosure, application, or use of the present disclosure. Although the embodiments have been described in the embodiments and illustrated in the accompanying drawings, the present disclosure is not limited to specific examples described in the accompanying drawings and as currently considered the best mode to implement the teachings of the present disclosure. The scope of the present disclosure will comprise any embodiments that fall within the preceding specifications and accompanying claims.

What is claimed is:

1. A vertical orthogonal top exhausting air duct structure of a subway station, comprising air duct split parts and an air duct main body part, wherein:

each air duct split part is located at its corresponding one of two sides of the air duct main body part, the air duct split parts and the air duct main body part are constructed simultaneously; the air duct split parts comprise a left piston air shaft, a right piston air shaft, an exhaust air shaft, a fresh air shaft, and partial air duct transverse channels, the partial air duct transverse channels comprising a partial left piston air duct transverse channel, a partial right piston air duct transverse channel, a partial exhaust air duct transverse channel and a partial fresh air duct transverse channel; the air duct main body part is divided into a first-stage open excavated foundation pit, hidden excavated arch cover parts, second-stage open excavated foundation pits, a third-stage open excavated foundation pit, and remaining air duct transverse channels, the remaining air duct transverse channels comprising a remaining left piston air duct transverse channel, a remaining right piston air duct transverse channel, a remaining exhaust air duct transverse channel, and a remaining fresh air duct transverse channel; the partial left piston air duct transverse channel is communicated with the remaining left piston air duct transverse channel and they form a left piston air duct transverse channel, the partial right piston air duct transverse channel is communicated with the remaining right piston air duct transverse channel and they form a right piston air duct transverse channel, the partial exhaust air duct transverse channel is communicated with the remaining exhaust air duct transverse channel and they form an exhaust air duct transverse channel; the partial fresh air duct transverse channel is communicated with the remaining fresh air duct transverse channel and they form a fresh air duct transverse channel; and the air duct main body part is located between at least one of a left or right running tunnels and a station main body;

a station main body part is communicated with the third-stage open excavated foundation pit; left and right running tunnels are communicated with the third-stage open excavated foundation pit; after the subway station is operable and configured to be put into use, a train enters the air duct main body part through the right running tunnel and then enters the station main body part, realizing the train's entrance to the subway station; and the train enters the air duct main body part through the station main body part and then enters the right running tunnel, realizing the train's exit from the subway station; the piston wind brought by the movement of the train will be carried by the train and enter the air duct main body part and then enter the left and right piston air shafts through the left and right piston air ducts transverse channel, thereby realizing a wind pressure balance between the external environment and the internal environment of a subway track area; a turbid gas inside the station main body enters the exhaust air duct transverse channel through ventilation pipelines of the station main body part and the air duct main body part, leads to the exhaust air shaft and then is discharged into the external environment; the fresh air from the outside enters the fresh air duct transverse channel through the fresh air shaft, then it enters the air duct main body part, and it finally enters the station main body part, so as to realize the gas exchange between a non-track area of the subway station and the external environment, and ensure the freshness of the air within the station.

2. A method for constructing the vertical orthogonal top exhausting air duct structure of the subway station according to claim 1, wherein construction of the air duct split parts comprising the following steps:

step 1.1: constructing locking ring beams at the positions above the ground of a left piston air shaft, a right piston air shaft, an exhaust air shaft, and a fresh air shaft, and installing foundation embedded parts of a lifting derrick;

step 1.2: carrying out an earthwork excavation for a vertical shaft, and excavating along with supporting;

step 1.3: spraying concrete for the first time, and installing a grid steel frame and a steel mesh;

step 1.4: spaying concrete to seal a surrounding rock;

step 1.5: repeating steps 1.2 to 1.4 until excavating to a bottom elevation of the vertical shaft;

step 1.6: sealing a bottom of the vertical shaft;

step 1.7: erecting three grid steel frames jointly from the left piston air shaft, the right piston air shaft, the exhaust air shaft, and the fresh air shaft, respectively, at positions of their respective air duct transverse channels, and setting a mortar anchor rod;

step 1.8: excavating the partial left piston air duct transverse channel, the partial right piston air duct transverse channel, the partial exhaust air duct transverse channel, and the partial fresh air duct transverse channel in full face from the left piston air shaft, the right piston air shaft, the exhaust air shaft, and the fresh air shaft, respectively, and constructing an anchor rod, binding a steel mesh, and spraying concrete;

step 1.9: laying a waterproof layer of a bottom plate and constructing the bottom plate;

step 1.10: laying remaining waterproof layers and constructing an arch part and the second lining of a side wall;

step 1.11: repeating steps 1.8 to 1.10 until partial piston air duct transverse channels being completed;

construction of the air duct main body part comprises the following steps:

step 2.1: before the excavation, carrying out dewatering inside a pit to lower the groundwater level to 1 m below the final excavation surface of a foundation pit; at a top of a slope, making an intercepting ditch and hardening ground to prevent surface water from seeping into the bottom of the slope;

step 2.2: setting a primary steel pipe pile in a rock stratum;

step 2.3: constructing a crown beam, erecting an knee bracing, and setting a prestressed anchor rod;

step 2.4: excavating a downward earthwork excavation, excavating a first-stage open excavated foundation pit layer by layer from top to bottom, spraying a layer of concrete to seal the surrounding rock after the excavation, then setting an anchor rod, hanging a steel mesh, and then constructing a sprayed concrete panel;

step 2.5: excavating the first-stage open excavated foundation pit layer by layer to an elevation of a support of arch cover feet, i.e., a top elevation of an initial support of an horizontal transverse channel, and beginning construction of a hidden excavated arch cover part;

step 2.6: setting an advanced large pipe shed in the first-stage open excavated foundation pit;

step 2.7: using shotcrete with a thickness of 100-200 mm or concrete with a thickness of 200-500 mm to seal the tunnel face;

step 2.8: firstly, excavating pilot tunnels on both side walls in sequence, spraying concrete to seal the surrounding rock, erecting a grid arch frame, erecting a temporary steel support, binding a steel mesh, and spraying concrete;

step 2.9: removing loosened soil at a foundation of grid feet after each grid arch frame being erected, and constructing a shotcrete cushion layer with a thickness of 100 mm as the foundation of the grid feet to ensure the stability of the grid;

step 2.10: excavating two middle pilot tunnels with a longitudinal offset of about 5 m; after excavation, spraying concrete immediately to seal the surrounding rock, erecting a grid arch frame, erecting a temporary steel support, binding a steel mesh, and spraying concrete;

step 2.11: constructing an arch cover structure and removing a temporary support in midspan in sections;

step 2.12: excavating of a second-stage open excavated foundation pit under protection of the arch cover structure;

step 2.13: after excavating to the bottom elevation of the air duct transverse channels, suspending the excavation and beginning excavating ingates on both sides to enter the tunnel, and excavating four remaining air duct transverse channels;

step 2.14: after the construction of a second lining of the remaining air duct transverse channels being completed, continuing a downward earthwork excavation; an excavation part of a third-stage open excavated foundation pit being vertically separated along an outer contour line of a station main body structure from the bottom elevation of the air duct transverse channels;

step 2.15: continuing a downward excavation within a range of a steel pipe pile, and constructing a support in same time;

step 2.16: where the pit being excavated to 300 mm above a foundation pit cushion layer, carrying out a foundation pit acceptance, and excavating the remaining earthwork manually; after excavating to a designed elevation, leveling the foundation pit immediately, draining the accumulated water in the pit, and constructing a cushion layer in time;

step 2.17: a hidden excavation construction of the station main body being carried out from the foundation pit of the air duct main body;

step 2.18: after the station main body structure being hidden excavated in full face and the tunnel being entered, laying a waterproof layer of the air duct main body structure, and then constructing the second lining structure of the air duct main body in sequence from bottom to top;

step 2.19: after the second lining structure of the air duct main body reaching 75% of a designed strength, backfilling and tamping earthwork to restore the ground.

3. The method according to claim 2, wherein:

a guide steel pipe with a diameter of $\phi$140 mm, a wall thickness of 5 mm, a length L=0.8 m is selected in step 2.6 to ensure the construction accuracy of a long pipe shed; and the long pipe shed covers the whole horizontal depth of the arch cover.

4. The method according to claim 3, wherein:

a length of the long pipe shed is 16 m, which is formed by hot-rolled seamless steel pipes with each section having a length of 4 m and being connected by threads; cement slurry is used for grouting with a water-cement ratio of 1:1 and a grouting pressure of 0.5-2.0 MPa; after grouting, the steel pipes are filled with cement mortar of M7.5 to enhance a strength of the pipe shed.

5. The method according to claim 2, wherein:

the construction of the second-stage open excavated foundation pit in step 2.12 is divided into two parts, one part comes from a continuous downward excavation of the first-stage open excavated foundation pit, and the other part comes from a downward covered excavation from hidden excavation segments under a protection of the arch cover; during construction, the principle of supporting followed by excavating is adopted; after excavation, a layer of concrete is sprayed immediately to seal the surrounding rock, then an anchor rod are set, a steel mesh is hung, and a sprayed concrete panel is constructed.

6. The method according to claim 2, wherein:

the remaining air duct transverse channels in step 2.13 comprises a remaining left piston air duct transverse channel and a remaining fresh air duct transverse channel; tunnel entrances of the remaining left piston air duct transverse channel and the remaining fresh air duct transverse channel are located below the first-stage open excavated foundation pit, and tunnel entrances of the remaining right piston air duct transverse channel and the remaining exhaust air duct transverse channel are located below the arch cover.

7. The method according to claim 6, wherein:

excavating in full face is used for the remaining left piston air duct transverse channel and the remaining fresh air duct transverse channel below the first-stage open excavated foundation pit to enter the tunnel, with specific steps as below:

A. excavating in full face, constructing an anchor rod, binding a steel mesh, and spraying concrete;

B. laying a waterproof layer of a bottom plate and constructing the bottom plate;

C. laying the remaining waterproof layer and constructing an arch part and the second lining of the side wall; the progress of the arch part and the second lining of the side wall should be one excavation footage behind an inverted arch of the bottom plate.

8. The method according to claim 6, wherein:

the remaining right piston air duct transverse channel and the remaining exhaust air duct transverse channel below the arch cover are excavated using a Center Diaphragm Method, with specific steps as below:

A. excavating a left pilot tunnel, spraying concrete immediately to seal the surrounding rock, erecting a grid steel arch frame and a vertical temporary steel support of I-type, binding a steel mesh, and then spraying concrete with a thickness of 150 mm;

B. excavating a right pilot tunnel with an offset of 0.5 m, spraying concrete immediately to seal the surrounding rock, and erecting a grid steel arch frame; after each grid arch being erected, removing the loosened soil at the foundation of the grid feet and constructing a shotcrete cushion layer with a thickness of 100 mm as the foundation of grid feet to ensure the stability of the grid;

C. after the arch cover reaching the designed strength, removing a temporary steel support of I-type, and constructing the second lining structure of the air duct at an ingate;

D. the length of the ingate segment is 3 m, and the excavation depth not exceeding 0.5 m; segments following the ingate section being excavated in full face.

9. The method according to claim 6, wherein:

the four remaining air duct transverse channels finally converge with the partial piston air duct transverse channels excavated from the air shaft in step 1.11 to form fully communicated air duct transverse channels.

10. The method according to claim 2, wherein:

in step 2.17, the station main body hidden excavated from the main foundation pit of the air duct is excavated using a three-bench-seven-step method.

* * * * *